US005745043A

United States Patent [19]

Lemke et al.

[11] Patent Number: 5,745,043

[45] Date of Patent: Apr. 28, 1998

[54] INDICATOR JUNCTION MODULE FOR PRESSURE WASHER

[75] Inventors: Alfred H. Lemke, Siloam Springs; Lenard K. Deiterman, Springdale; K. Leon Anderson, Siloam Springs, all of Ark.

[73] Assignee: Clarke Industries, Inc., Springdale, Ark.

[21] Appl. No.: 722,582

[22] Filed: Oct. 15, 1996

[51] Int. Cl.[6] ..... G08B 5/00

[52] U.S. Cl. ..... 340/815.4; 340/815.45; 340/521; 73/168

[58] Field of Search ..... 340/461, 513, 340/521, 525, 591, 641, 642, 815.4, 815.42, 815.45, 931, 458, 500, 501, 825.16, 825.17; 362/249, 252, 800, 307; 313/499, 500, 512; 257/88, 91, 99, 100; 73/866.3, 168, 714

[56] References Cited

U.S. PATENT DOCUMENTS

| | | | |
|---|---|---|---|
| 2,959,774 | 11/1960 | Arrasmith | 340/324 |
| 3,107,350 | 10/1963 | Arrasmith | 340/381 |
| 3,292,174 | 12/1966 | Toth et al. | 340/381 |
| 3,354,454 | 11/1967 | Rueger | 340/381 |
| 3,631,477 | 12/1971 | Matsushima | 340/381 |
| 3,717,117 | 2/1973 | Stanley | 116/128 |
| 3,808,581 | 4/1974 | Murray | 339/95 |
| 3,950,844 | 4/1976 | Wisbey | 29/577 |
| 3,969,721 | 7/1976 | Chadwick et al. | 340/381 |
| 4,126,855 | 11/1978 | Alms et al. | 340/381 |
| 4,271,455 | 6/1981 | McComas | 361/331 |
| 4,277,819 | 7/1981 | Sobota et al. | 362/80 |
| 4,463,399 | 7/1984 | Matherly et al. | 361/1 |
| 4,485,377 | 11/1984 | Claus et al. | 340/719 |
| 4,502,084 | 2/1985 | Hannett | 361/23 |
| 4,553,702 | 11/1985 | Coffee et al. | 239/690 |
| 4,697,464 | 10/1987 | Martin | 73/866.3 |
| 4,698,730 | 10/1987 | Sakai et al. | 362/311 |
| 4,712,163 | 12/1987 | Oxley | 362/29 |
| 4,929,866 | 5/1990 | Murata et al. | 313/500 |
| 4,933,545 | 6/1990 | Saaski et al. | 250/227.14 |
| 4,987,404 | 1/1991 | Gerosa et al. | 340/461 |
| 5,036,248 | 7/1991 | McEwan et al. | 313/500 |
| 5,066,889 | 11/1991 | Edwards | 313/512 |
| 5,313,729 | 5/1994 | Sakai et al. | 40/452 |
| 5,382,811 | 1/1995 | Takahashi | 257/88 |
| 5,387,901 | 2/1995 | Hardt | 340/815.42 |
| 5,404,828 | 4/1995 | Klinke et al. | 362/249 |
| 5,436,809 | 7/1995 | Brassier et al. | 362/61 |
| 5,490,048 | 2/1996 | Brassier et al. | 362/238 |

FOREIGN PATENT DOCUMENTS

| | | |
|---|---|---|
| 1-264538 | 10/1989 | Japan . |
| 4-219896 | 10/1992 | Japan . |
| 955550 | 4/1964 | United Kingdom . |

*Primary Examiner*—Brent A. Swarthout
*Assistant Examiner*—Van T. Trieu
*Attorney, Agent, or Firm*—Senniger, Powers, Leavitt & Roedel

[57] ABSTRACT

An indicator junction module for connecting the electrical components of a pressure washer for dispensing a cleaning fluid under pressure. The indicator junction module includes terminal connectors for receiving leads from the components and indicator circuits corresponding to the components. At least one of the indicator circuits has one of its terminals electrically connected to an indicator device and the other of its terminals electrically connected to another indicator circuit. Each indicator device provides a visual indication of a condition of the corresponding component. The indicator junction module also includes an enclosure for enclosing the indicator circuits wherein the indicator devices are visible from outside the enclosure to an operator of the pressure washer and a portion of each terminal connector is external to the enclosure. Each terminal connector is electrically connected to one of the indicator circuit terminals so that the components connected to the terminal connectors are electrically connected to each other via the indicator circuits. Other features are also disclosed including a method of manufacturing the pressure washer indicator module.

15 Claims, 8 Drawing Sheets

INDICATOR JUNCTION MODULE FOR PRESSURE WASHER

BACKGROUND OF THE INVENTION

This invention relates generally to a high pressure washer used for heating a cleaning fluid and jetting the fluid under pressure onto a surface to clean it and, more particularly, to such a washer having a convenient junction module for connecting the components of the washer's electrical system and providing a visual indication concerning a condition of the components.

In pressure washers of conventional design, a burner introduces hot gaseous products of combustion into a combustion chamber surrounded by a heating coil containing a liquid cleaning solution under pressure (e.g., up to 4,000 psi or greater). The solution is then heated as it flows through the coil. After being heated to a suitable temperature (e.g., 200° F.), the solution is dispensed by means of a hose, spray wand and nozzle, for example, onto a surface to be cleaned. Pressure washers of this type have been made by various companies, including Clarke Industries, Inc. which sells such washers under the trademark DELCO™.

Such pressure washers include a variety of electrical components which must be electrically connected to each other for proper operation of the washer. Typically, wires leading from the various electrical components of the pressure washer are connected in a central location (e.g., the control box) for ease of assembly and maintenance. These wires may be joined by wire nuts, soldering, crimp type terminal splices, or terminal strips. One disadvantage with conventional connecting schemes is that they are confusing and the wires can become tangled which makes it more difficult to troubleshoot maintenance problems. Further, in such wiring schemes, the connections often become loose due to vibrations, moving the pressure washer, and the like and are subject to becoming corroded. For this reason, a means for wiring the components of a pressure washer's electrical system is needed which provides convenient, orderly and secure connections and which protects the connections and other circuitry from corrosion.

Further, during maintenance or troubleshooting, a service technician, for example, must determine the status or condition of the various electrical components in order to diagnose and correct improper washer operation. This typically involves using a handheld meter to determine whether the components are conducting current. Disadvantageously, the wires often have to be at least partially disconnected in order to take such measurements. Given the disorderly fashion in which the components are wired, disconnecting and reconnecting the components is troublesome. Therefore, an apparatus which provides a visual indication of a condition of the components and provides for convenient access with a meter is desired.

Although it is contemplated that pilot, or indicator, lamps may be used for indicating the status of some or all of the components, in conventional washers the use of such lamps complicates the already complicated wiring inside the control box. For this reason, a means for wiring the components of a pressure washer's electrical system is needed which provides convenient, orderly, secure and corrosion resistant connections in addition to providing a visual indication of the status or condition of the electrical system components.

SUMMARY OF THE INVENTION

Among the several objects of this invention may be noted the provision of a pressure washer having an indicator junction module; the provision of such a pressure washer which permits convenient, orderly and secure wiring connections; the provision of such a pressure washer which protects the connections from corrosion and the like; the provision of such a pressure washer which provides for ease of troubleshooting; the provision of such a pressure washer which provides information regarding the status of the components without disconnecting the components; the provision of such a pressure washer which provides a visual indication of a condition of the components; the provision of an indicator junction module for use in such a pressure washer; the provision of such a pressure washer which indicates sufficient electrical power for operation; and the provision of such a pressure washer which is economically feasible and commercially practical.

Briefly described, a pressure washer embodying aspects of the invention is for dispensing a cleaning fluid under pressure. The pressure washer includes an electrical system having a plurality of components electrically connected by an indicator junction module that includes a plurality of indicator circuits. Each indicator circuit corresponds to one of the components and includes a pair of terminals and an indicator device. At least one of the indicator circuits has one of its terminals electrically connected to its indicator device and the other of its terminals electrically connected to another one of the indicator circuits. Each indicator device provides a visual indication of a condition of the corresponding component. The indicator junction module also includes an enclosure for enclosing the indicator circuits wherein the indicator devices are visible from outside the enclosure to an operator of the pressure washer. The indicator junction module further includes a plurality of terminal connectors, a portion of each being external to the enclosure for receiving leads from the components thereby to form an electrical connection. Each terminal connector is electrically connected to one of the indicator circuit terminals so that the components connected to the terminal connectors are electrically connected to each other via the indicator circuits whereby the module provides a convenient interface between the components of the electrical system.

In another embodiment, an indicator junction module embodying aspects of the invention is for connecting a plurality of electrical components which are part of a pressure washer for dispensing a cleaning fluid under pressure. The module includes a plurality of indicator circuits. Each indicator circuit corresponds to one of the components and includes a pair of terminals and an indicator device. At least one of the indicator circuits has one of its terminals electrically connected to its indicator device and the other of its terminals electrically connected to another one of the indicator circuits. Each indicator device provides a visual indication of a condition of the corresponding component. The indicator junction module also includes an enclosure for enclosing the indicator circuits wherein the indicator devices are visible from outside the enclosure to an operator of the pressure washer. The indicator junction module further includes a plurality of terminal connectors, a portion of each being external to the enclosure for receiving leads from the components thereby to form an electrical connection. Each terminal connector is electrically connected to one of the indicator circuit terminals so that the components connected to the terminal connectors are electrically connected to each other via the indicator circuits whereby the module provides a convenient interface between the components of the electrical system.

Another embodiment of the invention is directed to a method of manufacturing a pressure washer indicator junction module for connecting a plurality of electrical components which are part of a pressure washer for dispensing a cleaning fluid under pressure. The method includes the step of constructing a plurality of indicator circuits on a printed circuit board. Each indicator circuit corresponds to one of the components and includes a pair of terminals and a light emitting diode. Each light emitting diode is positioned on one side of the printed circuit board and provides a visual indication of a condition of the corresponding component. The method also includes connecting a plurality of terminal connectors to the printed circuit board for receiving leads from the components thereby to form an electrical connection. Each terminal connector is electrically connected to one of the indicator circuit terminals and positioned on an opposite side of the printed circuit board from the light emitting diodes. The method also includes the steps of positioning the printed circuit board in a mold and inserting the light emitting diodes in openings in the mold adapted to receive the light emitting diodes. The method further includes the step of filling the mold with an electrically insulating potting material such that the printed circuit board is substantially covered by the potting material and a portion of each terminal connector projects from the potting material. The method also includes allowing the potting material in the mold to harden and removing the hardened potting material from the mold. As such, a portion of each light emitting diode is exposed for providing the visual indication.

Other objects and features will become in part apparent and in part pointed out hereinafter.

BRIEF DESCRIPTION OF THE DRAWINGS

Corresponding parts are designated by corresponding reference characters and numerals throughout the several views of the drawings.

DESCRIPTION OF THE PREFERRED EMBODIMENTS

Figure 1:
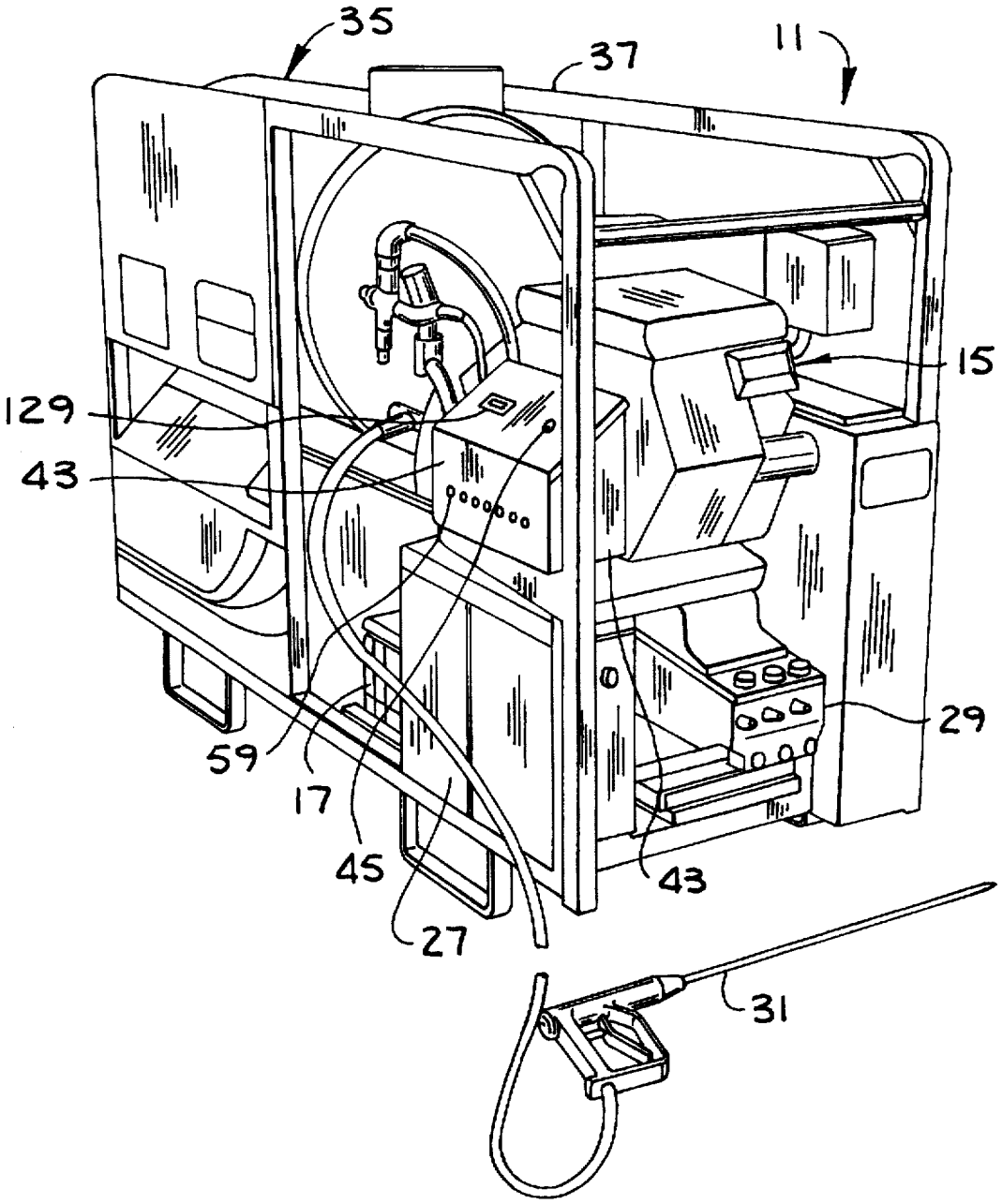
FIG. 1 is a perspective of a pressure washer according to the invention.
Figure 2:
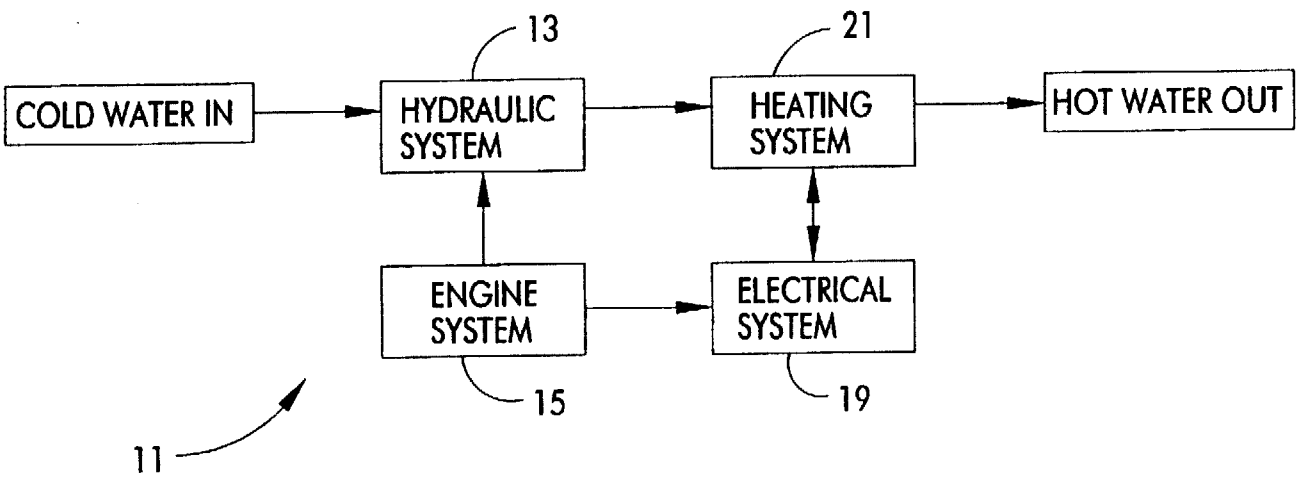
FIG. 2 illustrates the pressure washer of FIG. 1 in block diagram form.

Referring now to FIG. 1, a pressure washer of the present invention is indicated in its entirety by the reference numeral 11. In general, the pressure washer 11 dispenses a heated cleaning fluid (e.g., water or water mixed with a suitable detergent, degreasing agent, etc.) under pressure onto a surface for cleaning the surface. As shown in the block diagram of FIG. 2, pressure washer 11 includes a hydraulic system 13 driven by an engine system 15 for pressurizing the cleaning fluid. For example, the engine system 15 includes a gasoline-powered engine coupled to the hydraulic system 13 by a conventional belt and pulley arrangement. It is contemplated, however, that engine system 15 may be replaced by an electric motor. In a preferred embodiment, engine system 15 includes a battery 17 (see FIG. 1) or other suitable power supply for providing electrical power to an electrical system 19. For example, in an alternative embodiment, an ac power source provides electrical power to pressure washer 11. As described in detail below, the electrical system 19 includes a number of electrical components for use in controlling the operation of pressure washer 11. Pressure washer 11 also includes a heating system 21 for heating the cleaning fluid before it is dispensed onto the surface to be cleaned. As shown in FIG. 2, electrical system 19 preferably communicates with the heating system 21 for controlling the temperature of the pressurized cleaning fluid.

Referring further to FIG. 1, during operation of pressure washer 11, water is collected in a reservoir referred to as a float tank and generally indicated at 27. Engine system 15 drives a pump 29 for drawing the water from the tank 27 to create a vacuum for introducing detergent, for example, to the water to produce a cleaning fluid. As described herein, tank 27 and pump 29 are part of hydraulic system 13. A user-operated dispenser or applicator in the form of a spray wand 31 then may dispense the fluid under pressure onto the surface to be cleaned.

Figure 5:
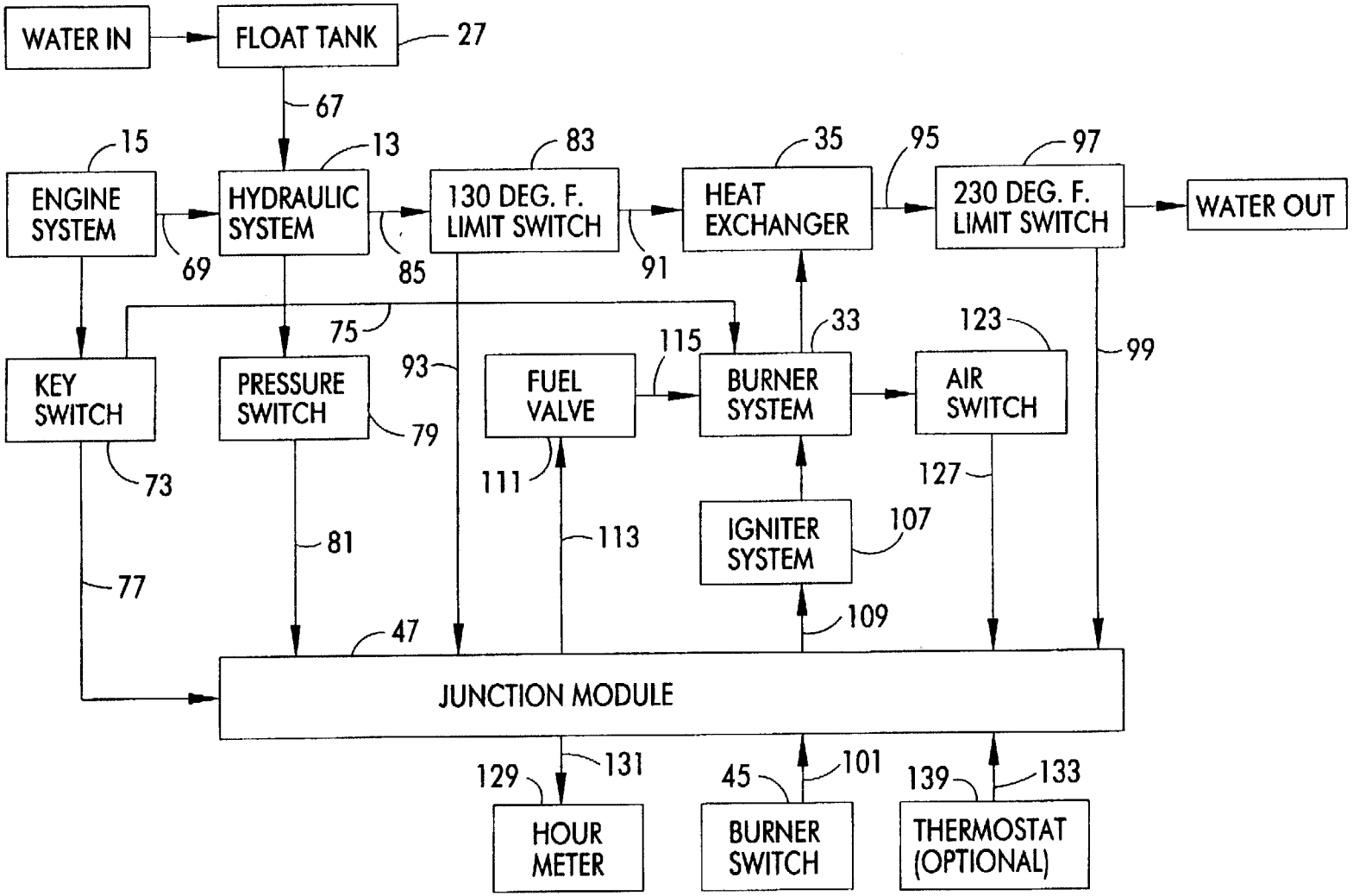
FIG. 5 illustrates the pressure washer of FIG. 1 including the indicator junction module of FIG. 3 in block diagram form.

According to a preferred embodiment of the invention, heating system 21 includes a burner assembly 33 for igniting and burning a fuel mix (see FIG. 5). In those applications in which a heated cleaning fluid is desired, the operator activates the burner 33 of heating system 21 which produces hot combustion gases. A heat exchanger 35 transfers the heat produced in burner 33 to the cleaning fluid. In general, burner 33 is operable to mix fuel (e.g., diesel fuel, propane, natural gas or other fuel) and air to form a combustible mixture which is then ignited and discharged into its combustion chamber (not shown) for combustion. Burner 33 may be of conventional design, such as a burner made by Wayne Home Equipment of Fort Wayne, Ind., model M-SR, model EH-SR or model EHA-SR. Commonly assigned application Ser. No. 08/635,459, filed Apr. 22, 1996, the entire disclosure of which is incorporated herein by reference, discloses an improved heat exchanger for use with a pressure washer.

Preferably, a frame 37 (FIG. 1) carries the various systems of pressure washer 11. Although not illustrated, it is contemplated that the frame 37 may also include wheels (not shown) for convenience in moving pressure washer 11 from one location to another. A control box 43 at the front of frame 37 provides operator access to a burner switch 45 for activating burner 33. In an alternative embodiment, the control box 43 also provides operator access to suitable controls for controlling the temperature of the dispensed fluid and/or for adjusting the mixture of chemicals in the cleaning solution.

To operate pressure washer 11, the operator first turns on engine system 13 with, for example, an engine ignition switch (not shown in FIG. 1). The engine ignition switch may also be referred to as a key or power switch. The operator then actuates burner 33 via burner switch 45 which causes a flaming mix of air and fuel to be discharged into the combustion chamber in a direction toward heat exchanger 35. As combustion occurs in the combustion chamber, a heat shield (not shown) directs the hot gases of combustion toward heat exchanger 35. Preferably, the cleaning fluid passes through a heating coil (not shown) in heat exchanger 35 wherein heat is transferred (by radiation and convection) to the cleaning fluid.

Figure 3:
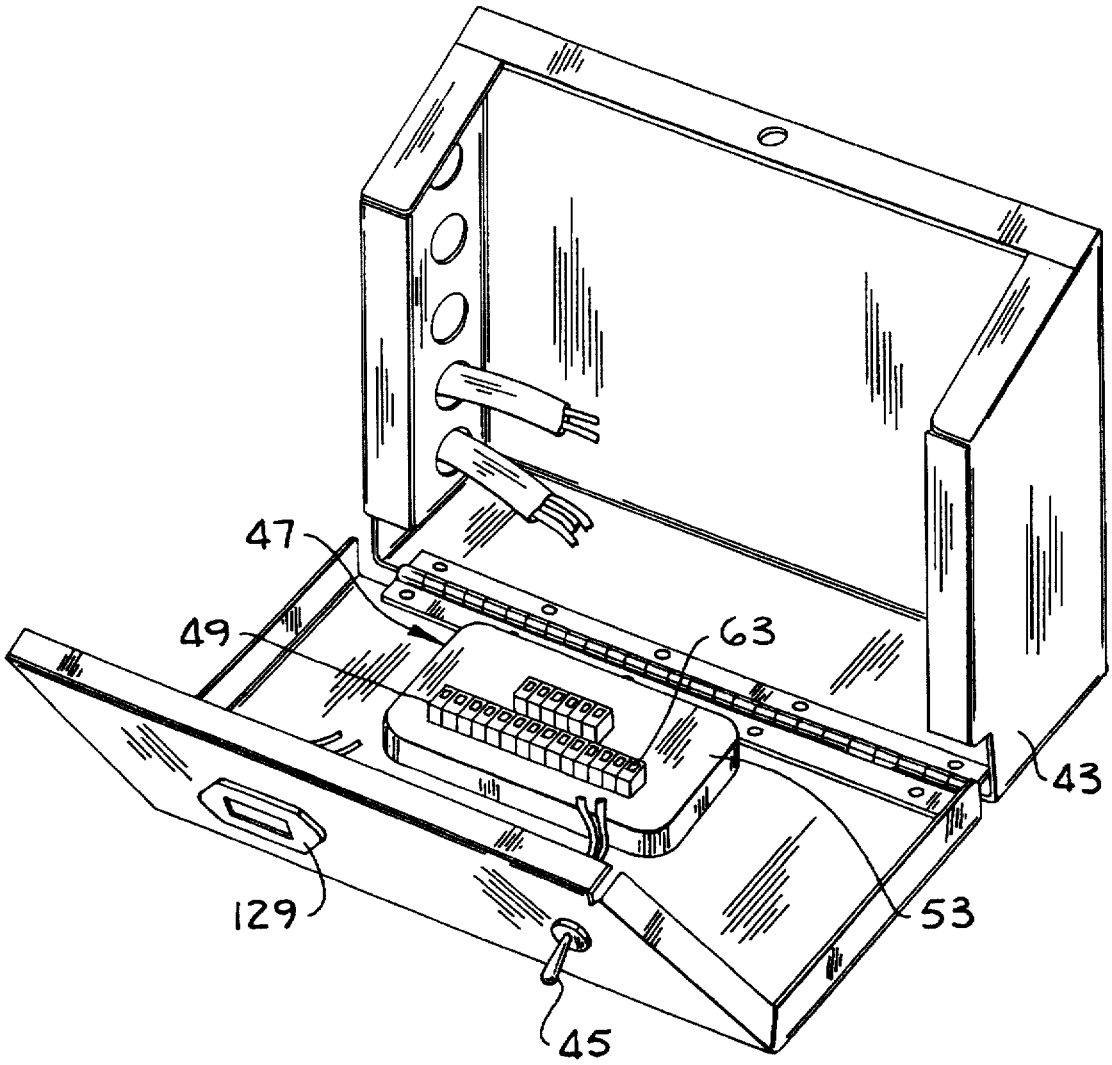
FIG. 3 is a perspective of the control box of the pressure washer of FIG. 1 having an indicator junction module according to the invention positioned therein.

FIG. 3 illustrates the interior of the control box 43. According to the invention, control box 43 houses an indicator junction module generally designated 47 which provides a means for connecting the various components of electrical system 19 to each other. In addition, module 47 provides an interface between electrical system 19 and the electrical components of the other systems of pressure washer 11 (e.g., the battery 17 of engine system 15). Thus, in this sense, battery 17 is part of electrical system 19 although it is grouped for convenience with engine system 15.

As shown in FIG. 3, module 47 includes a plurality of terminal connectors 49. Preferably, the terminal connectors 49 are embodied by cage clamp terminal blocks, such as those sold by WAGO Corporation of Brown Deer, Wis. under its model numbers 255-414 and/or 255-406. In one preferred embodiment, each pair of terminal connectors 49 corresponds to one component of electrical system 19. Preferably, the terminal connectors 49 are filled with an anti-corrosive grease or gel such that the wires inserted in therein are embedded in the grease or gel and, thus, protected from oxidation and/or corrosion. Advantageously, terminal connectors 49 are interconnected by a plurality of indicator circuits described below.

Figure 4A:
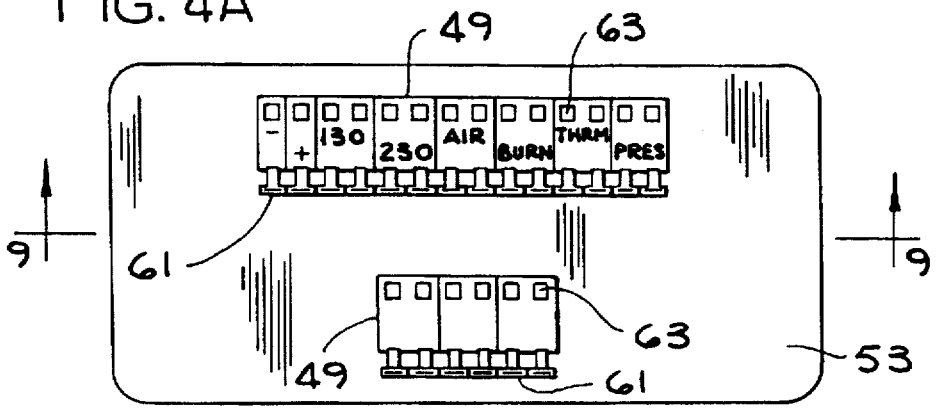
FIGS. 4A–4C are back, side and front views, respectively, of the indicator junction module of FIG. 3.
Figure 4B:
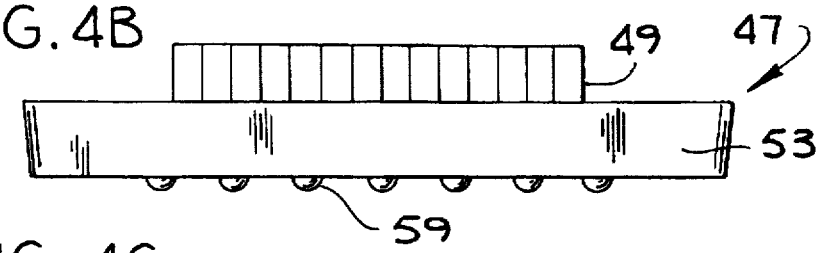
Figure 4C:
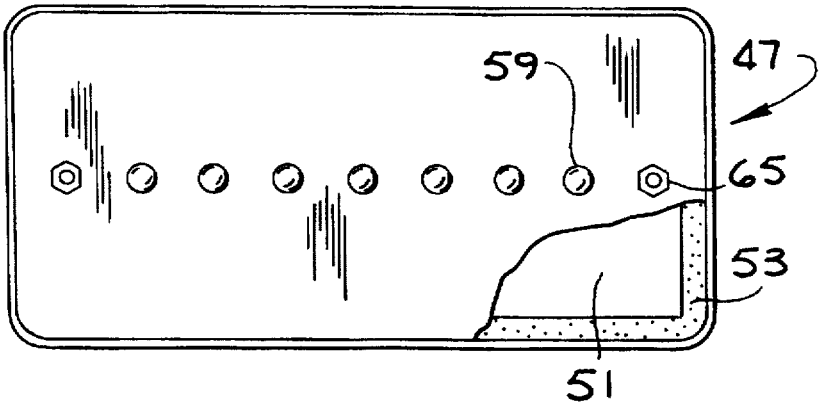

FIGS. 4A–4C illustrate indicator junction module 47 from the rear, side and front, respectively. In one preferred embodiment of the invention, indicator junction module 47 includes a printed circuit board 51 embedded in a mass of electrically insulating potting material 53. As an example, epoxy resin of the type manufactured by Castall or Master Bond is a suitable potting material. In this instance, the potting material 53 hardens around printed circuit board 51 to form a substantially watertight enclosure for a plurality of indicator circuits (see FIGS. 6 and 7) constructed on board 51. As such, the present invention protects the circuits from corrosion, vibrations and other damage which may result from their environment by providing a robust and substantially watertight enclosure. It is to be understood that various constructions are contemplated without deviating from the scope of the invention. For example, printed circuit board 51 may be contained within other types of enclosures, such as a sealed box or casing.

According to the invention, the indicator circuits constructed on board 51 include a plurality of indicator devices. Preferably, the indicator devices provide a visual indication of a condition of one or more of the components of electrical system 19. For example, incandescent bulbs, light emitting diodes, thermal resistive indicator circuits and the like are suitable indicator devices. In a preferred embodiment, light emitting diodes (LED's) 59 constitute indicator devices and are positioned on one side of potting material 53 and project therefrom. In contrast, terminal connectors 49 are connected to printed circuit board 51 and positioned on an opposite side of potting material 53. In this embodiment, each terminal connector 49 includes a lever 61 which releases a spring clamp connector (not shown) internal to the terminal connector 49 when it is depressed. When the lever of the spring clamp connector is depressed, a stripped wire lead from a component may be inserted into an opening 63 of the particular terminal connector 49. When the lever is released, the spring clamp connector internal to the particular terminal connector 49 engages the wire inserted therein. In this instance, the spring clamp connector secures the wire lead in position and forms an electrical connection when lever 61 is no longer being depressed. As such, opening 63 in cooperation with lever 61 constitutes means for receiving leads from the components. Preferably, lever 61 and opening 63 of each terminal connector 49 project from potting material 53 so that they are accessible to a user. In one preferred embodiment, a lubricant such as silicone grease may be applied in the openings 63 or to the stripped wire leads to further prevent corrosion.

As described above, pressure washer 11 includes control box 43 for housing indicator junction module 47. In one embodiment, at least one fastener member, such as a hex head nut 65 of a conventional nut-and-bolt arrangement, is affixed to printed circuit board 51 and embedded in potting material 53 for use in releasably securing indicator junction module 47 to an inside surface of control box 43. Preferably, control box 43 includes a series of holes or windows corresponding to LED's 59 so that the LED's 59 are visible to an operator of pressure washer 11 when junction module 47 is inside control box 43. In one embodiment, a gasket (not shown) is disposed between control box 43 and indicator junction module 47 for providing additional protection from dust, water, contaminants and the like.

Referring now to the block diagram of FIG. 5, the relationships between the various systems and components of pressure washer 11 are shown. During operation of pressure washer 11, water is collected in the float tank 27. Hydraulic system 13, including pump 29, draws the water from float tank 27 as indicated by line 67 for mixing with a cleaning agent and for causing the solution to flow through heat exchanger 35. As described above, engine system 15 drives hydraulic system 13 (as shown via line 69). In addition, battery 17, when connected to electrical system 19 by key switch 73, provides power to burner 33 via line 75 and to indicator junction module 47 via line 77. As an example, battery 17 is a 12 volt DC battery. When the operator actuates spray wand 31, the cleaning fluid exits spray wand 31 which in turn actuates a pressure switch 79. Although referred to as a pressure switch, it is to be understood that pressure switch 79 may be embodied by a pressure switch, vacuum switch or flow switch. In any event, pressure switch 79 indicates that cleaning fluid is flowing from spray wand 31. According to the invention, pressure switch 79 is connected to junction module 47 via line 81.

In a preferred embodiment of the invention, pressure washer 11 includes a normally closed temperature limit switch 83 which communicates with hydraulic system 13 as indicated by line 85. In this embodiment, the temperature limit switch 83 is responsive to the temperature of the cleaning fluid at the inlet of heat exchanger 35 represented by line 91. Advantageously, switch 83 determines when the cleaning fluid reaches a predetermined temperature limit prior to heating by heat exchanger 35 or when the cleaning fluid exceeds the temperature limit due to a failure elsewhere in electrical system 19 or hydraulic system 13. For example, switch 83 opens when the fluid being pumped into heat exchanger 35 by pump 29 is greater than or equal to 130° F. As shown in the block diagram of FIG. 6, a line 93 connects switch 83 to junction module 47.

As indicated in FIG. 5 at line 95, heated cleaning fluid leaves heat exchanger 35. Another normally closed temperature limit switch 97 is responsive to the temperature of the cleaning fluid at the outlet of heat exchanger 35 prior to dispensing of the fluid by spray wand 31. In a manner similar to switch 83, temperature limit switch 97 determines when the cleaning fluid reaches a predetermined temperature limit after heating by heat exchanger 35. For example, switch 97 opens when the heated cleaning fluid is greater than or equal to 230° F. As before, a line 99 connects switch 97 to junction module 47.

With respect to heating system 21, burner 33 is responsive to burner switch 45 (e.g., a user-operated toggle switch). As shown in FIG. 5, burner switch 45 is connected to junction module 47 via line 101. An igniter system 107 connected to junction module 47 via line 109 ignites the fuel mixture in burner 33 for producing the combustion gases. In this instance, a fuel valve 111 (e.g., a solenoid valve) connected to junction module 47 via line 113 provides the fuel to burner 33. The fuel flow from the fuel valve 111 to burner 33 is represented in the block diagram of FIG. 5 by line 115.

In operation, an air switch 123 determines when the air pressure within burner 33 as compared to atmospheric pressure, is sufficient for burner 33 to operate properly. In this instance, the pressure is indicative of the air flow through burner 33 which is related to the speed of a blower fan (not shown) associated with the burner 33. As with the other components of pressure washer 11, air switch 123 is connected to junction module 47 via line 127.

Further, pressure washer 11 advantageously includes a timer, or hour meter 129, for timing the hours of operation of pressure washer 11. In a preferred embodiment, hour meter 129 is connected to junction module 47 via line 131 such that only the time in which air switch 123 is closed is timed. In an alternative embodiment, pressure washer 11 includes a thermostat 133 for regulating heating system 21. According to the invention, the thermostat 133 is connected to junction module 47 via line 139.

It will be apparent from the foregoing that pressure washer 11 is comprised of engine system 15, hydraulic system 13, heating system 21 and electrical system 19. As shown in the block diagram of FIG. 5, electrical system 19 preferably includes a number of electrical components such as water inlet temperature limit switch 83 and water outlet temperature limit switch 97, both for preventing operation of pressure washer 11 when the water (or solution) exceeds a predetermined temperature limit, air pressure switch 123 which closes when the operating speed of pressure washer 11 is greater than or equal to a minimum operating speed at which burner 33 is allowed to operate, burner toggle switch 45 for selectively activating heating system 21 for heating the cleaning fluid, fluid pressure switch 79 which closes when pressure washer 11 is dispensing the cleaning fluid under pressure, fuel valve 111 for providing fuel to burner 33, igniter 107 for igniting fuel in burner 33, and hour meter 129 for timing the operation of pressure washer 11. In addition, electrical system 19 includes battery 17. In one embodiment, electrical system 19 also includes thermostat switch 133 for regulating the temperature of the cleaning fluid.

All of these components are interrelated as shown in FIG. 5. According to the prior art, wires leading from the various electrical components of pressure washer 11 are connected in a central location (e.g., control box 43) for ease of assembly and maintenance. These wires may be joined by, for example, wire nuts, soldering or crimp type terminal splices. In contrast, the present invention provides indicator junction module 47 for connecting the components. In addition to providing convenient and secure connections for the various components of pressure washer 11, junction module 11 further provides a visual indication of the status or condition of each component connected thereto. As will be described in detail below, junction module 47 includes a number of indicator circuits that have visual indicators for providing information regarding the condition of a corresponding component.

Figure 6:
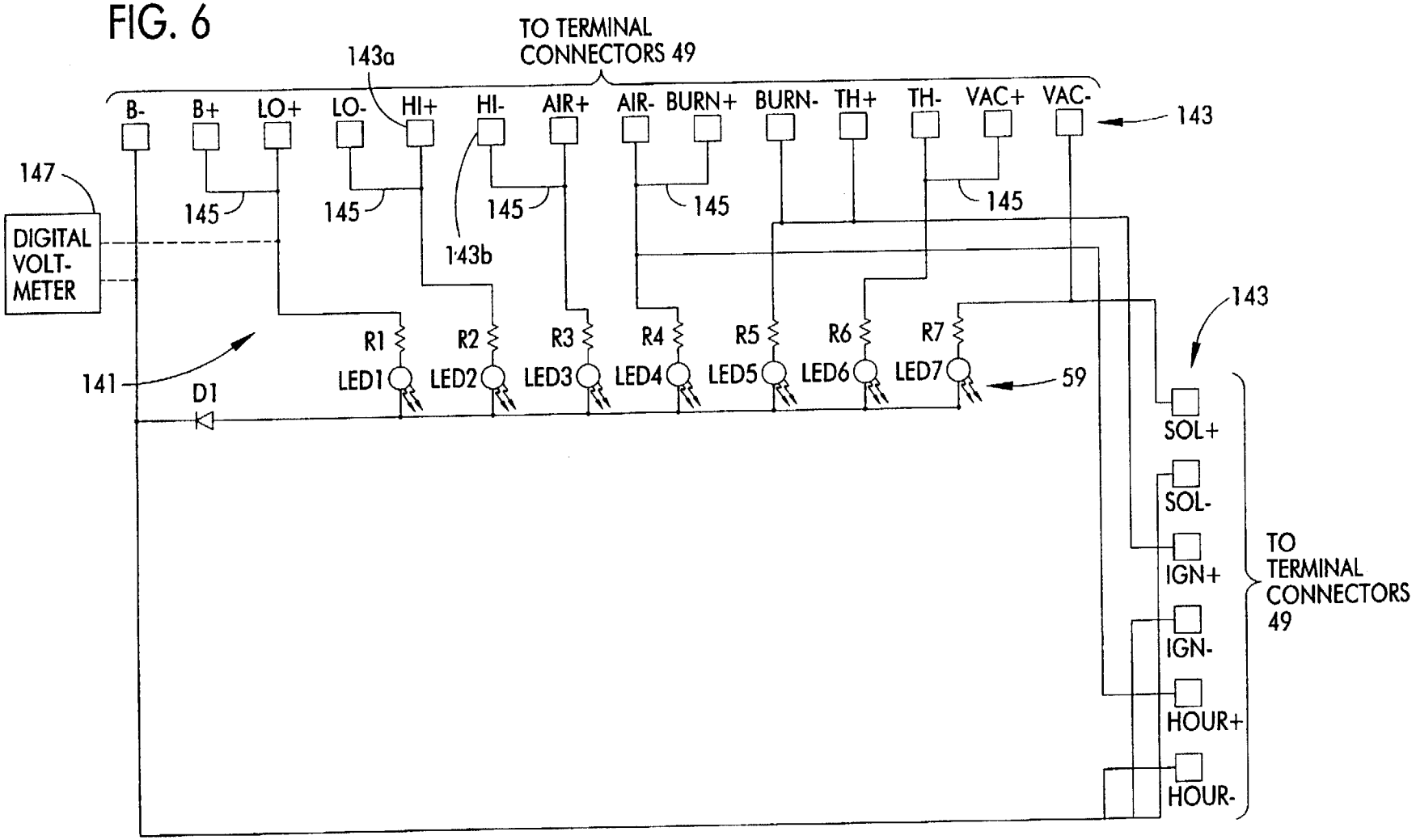
FIG. 6 illustrates the indicator junction module of FIG. 3 in schematic diagram form according to one preferred embodiment of the invention.

FIG. 6 shows a preferred embodiment of a plurality of indicator circuits 141 constructed on printed circuit board 51. Each indicator circuit 141 corresponds to one of the components of the pressure washer 11 and includes a pair of terminals 143 as well as one LED 59. In the embodiment shown, seven indicator circuits 141 (the number may vary) are illustrated. For example, the circuitry of FIG. 6 corresponds to indicator junction module 47 as shown in FIG. 4C. At least one of the indicator circuits 141 has one of its terminals 143 electrically connected to its LED 59 and the other of its terminals 143 electrically connected to another one of the indicator circuits 141 by a conductor 145. Each terminal connector 49 is electrically connected to one of the indicator circuit terminals 143 so that the components connected to terminal connectors 49 are electrically connected to each other via the indicator circuits 141 whereby module 47 provides a convenient interface between the components of electrical system 19. Preferably, each LED 59 provides a visual indication of a condition of the corresponding component.

For example, one such indicator circuit 141 includes terminals **143*a* and 143*b*, a resistor R3 and LED3. In the example, one terminal connector 49 is connected to terminal 143*a* and an adjacent terminal connector 49 is connected to terminal 143*b*. A pair of leads from temperature limit switch 97 are inserted into these two terminal connectors 49 so that switch 97 is connected in series between indicator circuit terminals 143*a*, 143*b***.

Indicator circuits 141, as connected by conductors 145, comprise positive and negative power buses. In this instance, the anodes of LED's 59 are preferably connected to the positive power bus and the cathodes of LED's 59 are preferably connected to the negative power bus. Further, indicator circuits 141 also include at least one anti-reversing diode D1. In a preferred embodiment, the cathodes of LED's 59 are electrically connected to the negative power bus via the anti-reversing diode D1 thereby inhibiting reverse voltage breakdown of the light emitting diodes.

As described above, indicator circuits 141 provide for at least one of the electrical system components to be electrically connected in series between a pair of terminals 143 of the corresponding indicator circuit 141. In the embodiment shown in FIG. 6, indicator circuit terminals 143 designated B+ and B− correspond to battery 17 and LED1 provides a visual indication of whether the key switch of engine system 15 is closed (i.e., whether junction module 47 is electrically connected to battery 17). Similarly, LO+ and LO− correspond to temperature limit switch 83 such that LED2 is on when switch 83 is closed (i.e., the inlet fluid temperature is less than, for example 130°) and the key switch is closed; HI+ and HI− correspond to temperature limit switch 97 such that LED3 is on when switch 97 is closed (i.e., the outlet fluid temperature is less than, for example 230°), switch 83 is closed, and the key switch is closed; and AIR+ and AIR− correspond to air switch 123 such that LED4 is on when air switch 123 is closed (i.e., the speed of the blower fan is sufficient to operate burner 33), switches 83, 97 are closed, and the key switch is closed. Thus, during a normal start-up of pressure washer 11, LED1-LED4 should be energized. Assuming each of the preceding LED's 59 in the sequence are on, LED5 turns on in response to burner switch 45 being closed to activate burner 33 (BURN+ and BURN− correspond to burner switch 45). In a like manner, TH+ and TH−, as well as LED6, correspond to thermostat 133, and VAC+ and VAC−, as well as LED7, correspond to pressure switch 79.

It is apparent from the foregoing that junction module 47 permits certain of the components of electrical system 19 to render pressure washer 11 inoperable. For example, if temperature limit switch 97 opens in response to an excessive temperature condition, power is no longer provided to the burner switch 45 which will prevent burner 33 from operating.

According to the invention, some of the indicator circuits 141 may have additional terminals for connecting to more than one component of electrical system 19. In other words, at least one of the components is electrically connected between the positive and negative power buses in parallel with the LED 59 of the corresponding indicator circuit 141. For example, hour meter 129 is connected to the indicator circuit 141 corresponding to air switch 123 via the terminals 143 labeled HOUR+ and HOUR−. Thus, hour meter 123 times the period in which pressure washer 11 is truly in use rather than merely the period in which the key switch of engine system 15 is on. Similarly, igniter system 107 is connected to the indicator circuit 141 corresponding to burner switch 45 via the terminals 143 labeled IGN+ and IGN−, and fuel valve 111 is connected to the indicator circuit 141 corresponding to pressure switch 79 via the terminals 143 labeled SOL+ and SOL−. Alternatively, it may be desirable to embody LED's 59 with combination diodes having at least two light emitting elements of different colors to indicate not only that a particular switch is closed but also to indicate that the component connected in parallel is drawing current.

Advantageously, LED's 59 (i.e., LED1–LED7) are visible from outside control box 43 to an operator of pressure washer 11. As such, indicator junction module 47 provides the operator, or service technician, with information regarding the operational condition of various components of electrical system 19 depending on which of LED's 59 are energized. For example, if pressure washer 11 is not operating properly and LED1–LED4 are illuminated but LED5 is not even when burner switch 45 is on, then the service technician can diagnose the problem as a defective burner switch 45 or burner switch wiring.

In one preferred embodiment, indicator junction module 47 provides a connection for an optional voltage sensor, such as a digital voltmeter 147 shown in phantom, for detecting voltage between the positive and negative power buses (i.e., across the B+ and B− terminals) and for displaying a value representative of the detected voltage. In another embodiment, the voltage sensor is a comparator (not shown) associated with a relay (not shown) for inhibiting some or all of the components of pressure washer 11 in the event that the voltage between the positive and negative power buses is not sufficient for operation.

Figure 7:
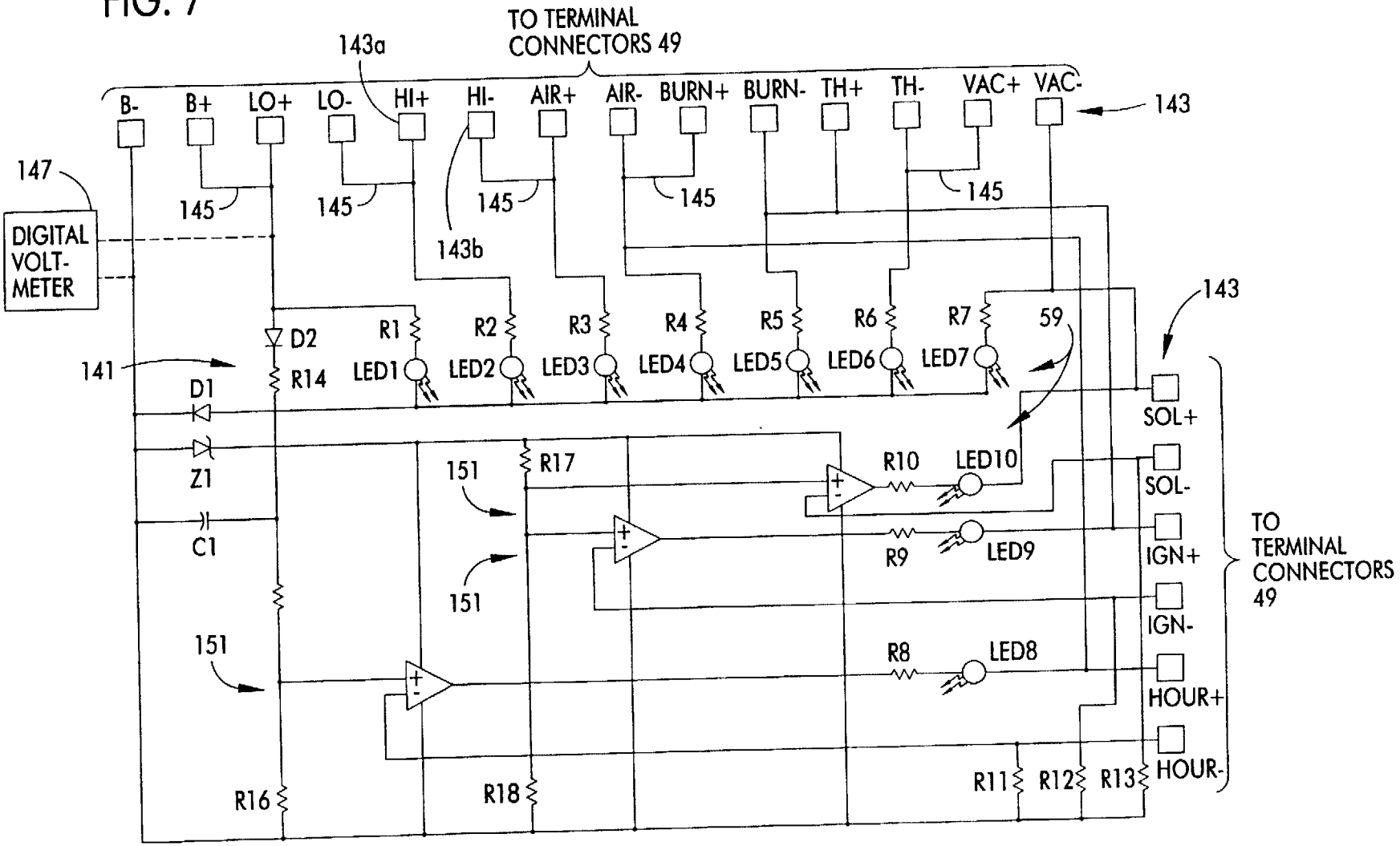
FIG. 7 illustrates the indicator junction module of FIG. 3 in schematic diagram form according to another preferred embodiment of the invention.

FIG. 7 illustrates an alternative embodiment of indicator junction module 47. Although similar to the circuitry shown in FIG. 6, the embodiment of FIG. 7 includes a current sensor circuit 151 associated with at least one of the indicator circuits 141 for detecting current being passed by the corresponding component. In this embodiment, the current sensor circuits 151 include visual indicators, such as additional LED's 59 (i.e., LED8–LED10), responsive to the detected current for indicating when the component is drawing current.

According to the preferred embodiments of the invention, the various circuit elements of FIGS. 6 and 7 may have the following values:

| | |
|---|---|
| R1–R10 | 2.2 kΩ |
| R11 | 10Ω |
| R12–R13 | 0.1Ω |
| R14 | 33 kΩ |
| C1 | 33 μF |
| R15 | 100 kΩ |
| R16 | 10 kΩ |
| R17 | 220 kΩ |
| R18 | 47 kΩ |

Figure 8:
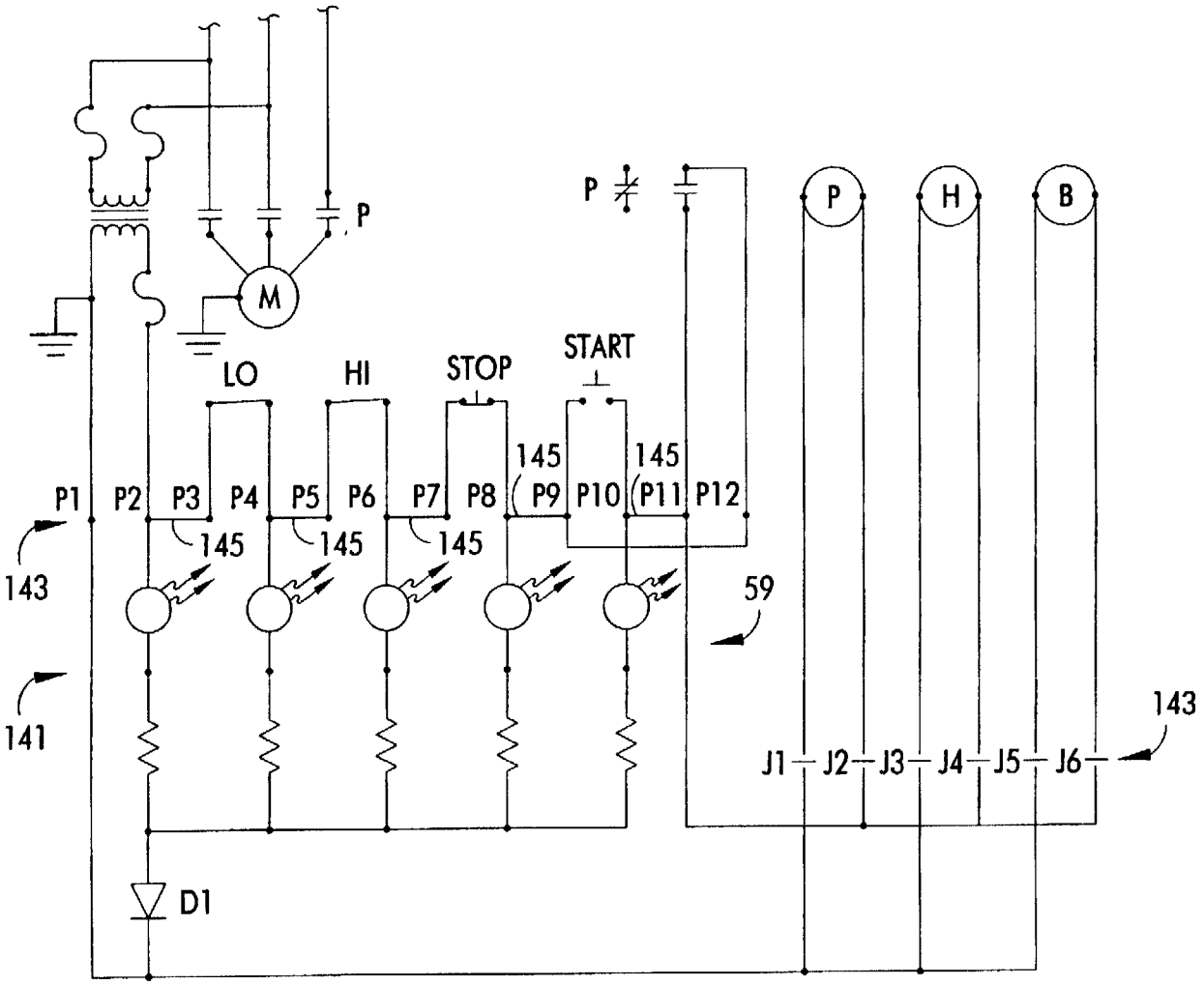
FIG. 8 illustrates the indicator junction module of FIG. 3 in schematic diagram form according to yet another preferred embodiment of the invention.

FIG. 8 illustrates yet another embodiment of indicator junction module 47. Although similar to the circuitry shown in FIGS. 6 and 7, the embodiment of FIG. 8 is for use with a pressure washer having an ac motor for driving hydraulic system 13.

Figure 9:
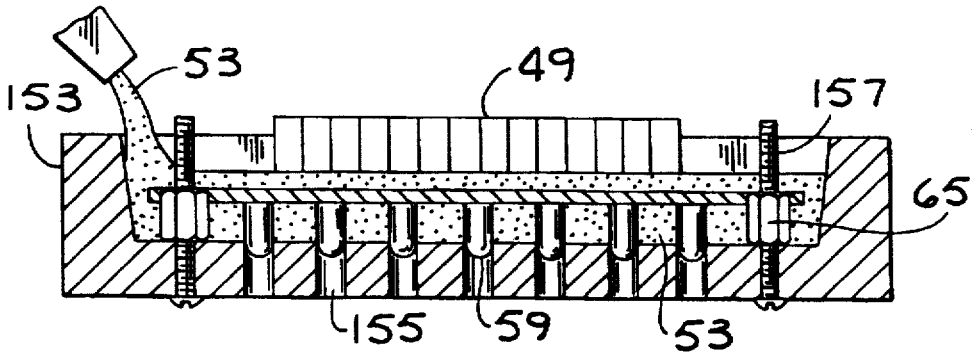
FIG. 9 is a sectional view of the indicator junction module of FIG. 3 taken generally along line 9—9 in FIG. 4A and including a mold for use in manufacturing the module according to the invention.

Referring now to FIG. 9, indicator junction module 47 is manufactured according to a preferred embodiment of the invention by first constructing indicator circuits 141 on printed circuit board 51. As described above, each indicator circuit 141 corresponds to one of the components of pressure washer 11 and includes a pair of terminals 143 and one LED 59. Constructing the circuitry on printed circuit board 51 includes electrically connecting one of the terminals 143 of at least one of the indicator circuits 141 to its LED 59 and electrically connecting the other of its terminals 143 to another one of the indicator circuits 141. Each LED 59 is positioned on one side of printed circuit board 51 and provides a visual indication of a condition of the corresponding component. The method of manufacture also includes connecting a plurality of terminal connectors 49 to printed circuit board 59 for receiving leads from the components thereby to form an electrical connection. Each terminal connector 49 is electrically connected to one of the indicator circuit terminals 143 and positioned on an opposite side of printed circuit board 51 from LED's 59.

According to the method of the invention, a mold 153 is used to form indicator junction module 47. Advantageously, the mold 153 has a series of openings 155 sized to receive LED's 59 in such a way that the openings 155 are sealed closed when LED's 59 are inserted therein. After positioning printed circuit board 51 in mold 153 and inserting LED's 59 in the openings 155, the method further includes filling the mold with the electrically insulating potting material 53 such that printed circuit board 51 is substantially covered by potting material 53 and a portion of each terminal connector 49 projects from potting material 53. By sealingly engaging LED's 59 in the mold openings 155, potting material 53 is prevented from leaking from mold 153 through openings 155 and/or from covering the ends of LED's 59 projecting from module 47. After potting material 59 hardens, module 47 may be removed from mold 153 and mold 153 may be re-used.

If desired, a pair of hex head nuts 65 may be positioned in mold 153 prior to it being filled with potting material 53. Preferably, the nuts 65 are crimped into or otherwise affixed to printed circuit board 51. As such, a screw 157 may be installed through mold 153 into the receiving threads of each nut 65 to secure printed circuit board 51 in mold 153 before it is filled with potting material 53. After curing, the screws 157 may be removed leaving nuts 65 embedded in potting material 53 to provide threaded female connectors by which junction module 47 may be fastened to an interior surface of control box 43.

It is to be understood that openings 155 for LED's 59 may be depressions in mold 153 which need not extend completely therethrough. In this instance, it is contemplated that the top surface of LED's 59 may be sanded to remove any potting material 53 which may be present thereon.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A pressure washer for dispensing a cleaning fluid under pressure, said pressure washer comprising:

an electrical system including a plurality of components electrically connected by an indicator junction module, said indicator junction module comprising:

a plurality of indicator circuits, each indicator circuit corresponding to one of the components and including a pair of terminals and an indicator device, at least one of the indicator circuits having one of its terminals electrically connected to its indicator device and the other of its terminals electrically connected to another one of the indicator circuits, each indicator device of the indicator circuits providing a visual indication of a condition of the corresponding component;

an enclosure for enclosing the indicator circuits, said indicator devices of the indicator circuits being visible from outside the enclosure to an operator of the pressure washer; and a plurality of terminal connectors having means for receiving leads from the components thereby to form an electrical connection, said receiving means being external to the enclosure, each terminal connector being electrically connected to one of the indicator circuit terminals so that the components connected to the terminal connectors are electrically connected to each other via the indicator circuits whereby the module provides a convenient interface between the components of the electrical system.

2. The pressure washer of claim 1 wherein at least one of the components is electrically connected in series between the terminals of the corresponding indicator circuit via the terminal connectors.

3. The pressure washer of claim 1 wherein one of the components is a power switch for selectively connecting a power supply to at least one of the indicator circuits when the power switch is conducting thereby to provide power via the indicator circuits to the components that are connected to the terminal connectors.

4. The pressure washer of claim 3 wherein the indicator device of the indicator circuit corresponding to the power switch indicates when the power supply is providing power to the indicator circuits.

5. The pressure washer of claim 3 wherein the indicator devices comprise light emitting diodes and the indicator circuits comprise positive and negative power buses and wherein anodes of the light emitting diodes are electrically connected to the positive power bus and cathodes of the light emitting diodes are electrically connected to the negative power bus.

6. The pressure washer of claim 5 wherein the indicator circuits include at least one anti-reversing diode and wherein the cathodes of the light emitting diodes are electrically connected to the negative power bus via the anti-reversing diode thereby inhibiting reverse voltage breakdown of the light emitting diodes.

7. The pressure washer of claim 5 wherein the indicator circuits comprise positive and negative power buses and wherein at least one of the components is electrically connected between the positive and negative power buses in parallel with the indicator device of the corresponding indicator circuit.

8. The pressure washer of claim 7 wherein the indicator circuit corresponding to the component electrically connected in parallel includes a current sensor for detecting current in the component.

9. The pressure washer of claim 8 wherein the current sensor includes a visual indicator responsive to the detected current for indicating when the component is drawing current.

10. The pressure washer of claim 5 further comprising a voltage sensor for detecting voltage between the positive and negative power buses and for displaying a value representative of the detected voltage.

11. The pressure washer of claim 1 wherein the pressure washer includes a heating system having a burner for heating the cleaning fluid before it is dispensed, and wherein the components include one or more of the following: at least one normally closed temperature limit switch which opens when the temperature of the cleaning fluid reaches a temperature limit; a normally open air pressure switch which closes when the operating speed of the pressure washer is greater than or equal to a minimum operating speed at which the burner is allowed to operate; a burner switch for selectively activating the heating system for heating the cleaning fluid; a thermostat switch for regulating the temperature of the cleaning fluid; a normally open fluid pressure switch which closes when the pressure washer is dispensing the cleaning fluid under pressure; a fuel valve for providing fuel to the burner; an igniter for igniting fuel in the burner; and a timer for timing the operation of the pressure washer.

12. The pressure washer of claim 1 wherein the enclosure is substantially watertight.

13. The pressure washer of claim 1 wherein the indicator devices comprise light emitting diodes.

14. An indicator junction module for connecting a plurality of electrical components, said components being part of a pressure washer for dispensing a cleaning fluid under pressure, said module comprising:

a plurality of indicator circuits, each indicator circuit corresponding to one of the components and including a pair of terminals and an indicator device, at least one of the indicator circuits having one of its terminals electrically connected to its indicator device and the other of its terminals electrically connected to another one of the indicator circuits, each indicator device of the indicator circuits providing a visual indication of a condition of the corresponding component;

an enclosure for enclosing the indicator circuits, said indicator devices of the indicator circuits being visible from outside the enclosure to an operator of the pressure washer; and a plurality of terminal connectors having means for receiving leads from the components thereby to form an electrical connection, said receiving means being external to the enclosure, each terminal connector being electrically connected to one of the indicator circuit terminals so that the components connected to the terminal connectors are electrically connected to each other via the indicator circuits whereby the module provides a convenient interface between the components of the electrical system.

15. A method of manufacturing a pressure washer indicator junction module for connecting a plurality of electrical components, said components being part of a pressure washer for dispensing a cleaning fluid under pressure, said method comprising the steps of:

constructing a plurality of indicator circuits on a printed circuit board, each indicator circuit corresponding to one of the components and including a pair of terminals and a light emitting diode, each light emitting diode being positioned on one side of the printed circuit board and being operable to provide a visual indication of a condition of the corresponding component;

electrically connecting one of the terminals of at least one of the indicator circuits constructed on the printed circuit board to its light emitting diode and electrically connecting the other of its terminals to another one of the indicator circuits constructed on the printed circuit board;

connecting a plurality of terminal connectors to the printed circuit board, said terminal connectors having means for receiving leads from the components thereby to form an electrical connection, each terminal connector being electrically connected to one of the indicator circuit terminals and positioned on an opposite side of the printed circuit board from the light emitting diodes; and enclosing the indicator circuits, said light emitting diodes of the indicator circuits being visible from outside the enclosure to an operator of the pressure washer.

* * * * *